US006308855B2

(12) United States Patent
Tisi

(10) Patent No.: US 6,308,855 B2
(45) **Date of Patent: *Oct. 30, 2001**

(54) METHODS OF SECURING LINERS WITHIN CONTAINERS

(75) Inventor: Antony Luigi Paul Tisi, High Oaks, 271 Benfleet Road, Benfleet, Essex 5S7 1PS (GB)

(73) Assignee: Antony Luigi Paul Tisi, Essex (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/194,516

(22) PCT Filed: May 23, 1997

(86) PCT No.: PCT/GB97/01409

§ 371 Date: Nov. 25, 1998

§ 102(e) Date: Nov. 25, 1998

(87) PCT Pub. No.: WO97/45340

PCT Pub. Date: Dec. 4, 1997

(30) Foreign Application Priority Data

May 25, 1996 (GB) ..... 9611047

(51) Int. Cl.[7] ..... B65D 25/14

(52) U.S. Cl. ..... 220/495.01; 200/1.6; 222/105

(58) Field of Search ..... 220/1.5, 1.6, 495.01; 296/39.1; 105/423; 410/68; 24/128, 343, 130; 383/22; 222/105, 183, 386.5

(56) References Cited

U.S. PATENT DOCUMENTS

| | | | | |
|---|---|---|---|---|
| 322,501 | * | 7/1885 | Taylor | 24/129 R |
| 3,988,810 | * | 11/1976 | Emery | 24/128 |
| 4,178,661 | * | 12/1979 | Klein | 24/130 |
| 4,432,121 | * | 2/1984 | Dupre | 24/343 |
| 4,792,239 | * | 12/1988 | Hamada et al. | 383/22 |
| 4,801,042 | * | 1/1989 | Hamada et al. | 220/1.6 X |
| 5,524,781 | * | 6/1996 | Podd et al. | 220/1.5 |
| 5,595,315 | * | 1/1997 | Podd et al. | 220/1.6 X |
| 5,639,164 | * | 6/1997 | Ishino et al. | 383/22 |
| 5,824,995 | * | 10/1998 | Wise | 219/393 |

FOREIGN PATENT DOCUMENTS

| | | | | |
|---|---|---|---|---|
| 294 387 | * | 1/1988 | (JP) | 383/17 |

* cited by examiner

*Primary Examiner*—Gene Mancene
*Assistant Examiner*—Joseph C. Merek
(74) *Attorney, Agent, or Firm*—Renner, Kenner, Greive, Bobak, Taylor & Weber

(57) ABSTRACT

A method of securing a flexible plastics liner (12) within a cargo container (10) uses a plurality of plastic retaining cords (17). Each cord (17) is either attached to the liner (12) at a suitable position (14), or is passed through a loop (43) (FIG. 9) or other receptor (31) (FIG. 8) secured to the liner. Each cord (17) has a self-jamming cleat (23) secured at or adjacent one end, to permit the cord to be coupled to a member (20) provided within the container (10) and then tensioned so as to suspend the liner therewithin. The cord may be passed through a hole (19) in the member (20) or a loop may be formed around the member (30) (FIG. 8) or (41) (FIG. 9).

21 Claims, 5 Drawing Sheets

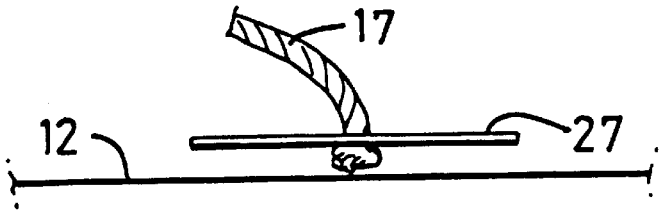
FIG.6A
FIG.6
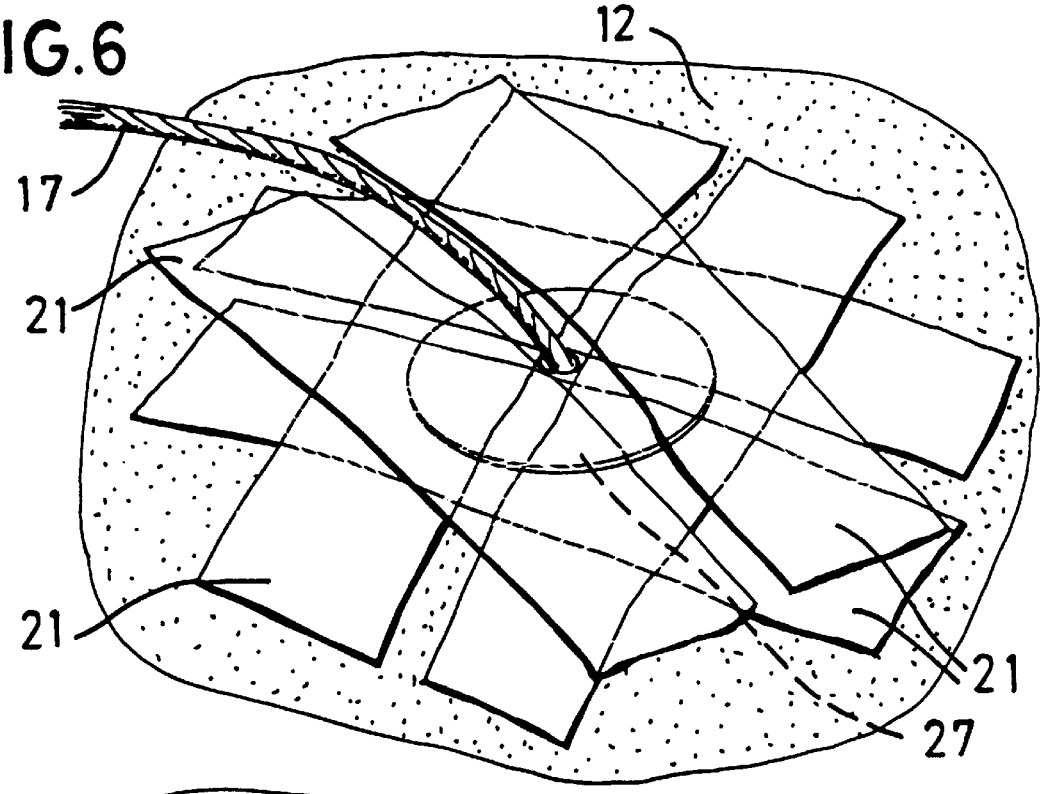
FIG.7
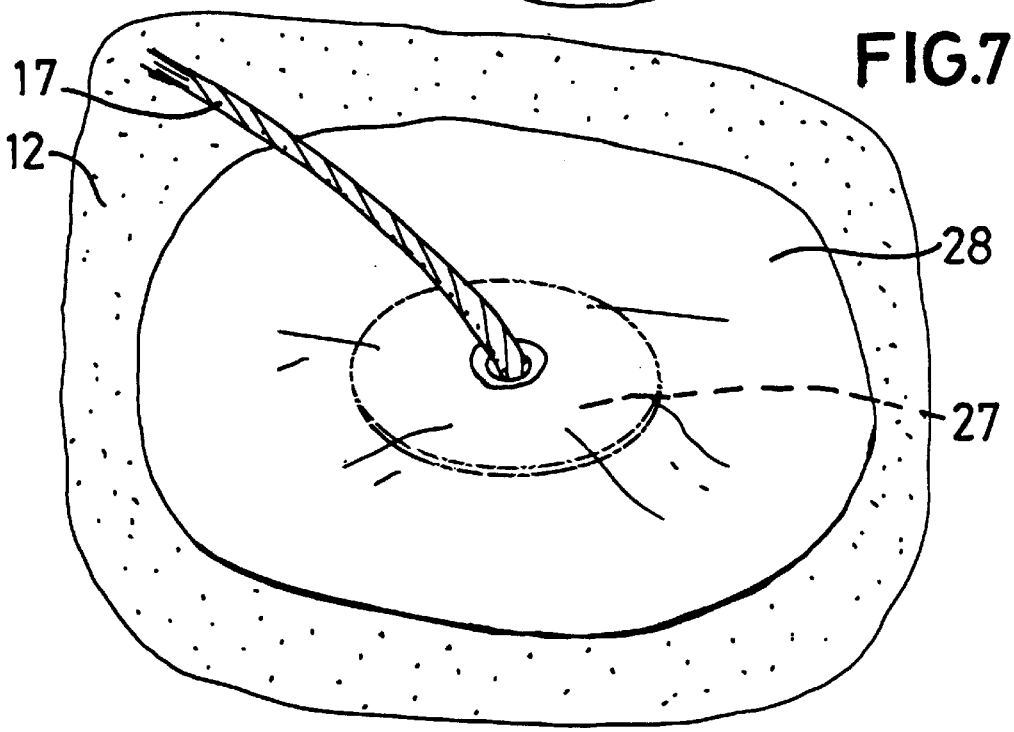

METHODS OF SECURING LINERS WITHIN CONTAINERS

TECHNICAL FIELD

This invention relates to a method of securing a flexible plastics material liner within a container, and also to a liner adapted for securing within a container. The invention further relates to the combination of a container and such a liner secured therewithin.

BACKGROUND OF THE INVENTION

Cargo containers, typically 7 m or 14 m long, are very widely used for the transport of goods by road, rail and sea. Such containers can be used for the transport of flowable solid products, such as powders, granules or other pulverulent materials. For this purpose, it is known to provide a flexible plastics material bag of a shape and size generally corresponding to the container interior, which bag is suspended in the container to serve as a liner. The products to be transported are then loaded into the bag, the container itself providing the required strength to permit the transportation, while the liner prevents leakage of the product. The liner may have an outlet opening which is held closed until the products are to be discharged, or the liner may simply be cut open, over a discharge hopper.

The fitting of a liner to the interior of a container must be performed carefully in order to avoid areas of high stress which could lead to tearing of the liner when the container is being used for the transport of goods. It is thus time consuming to suspend a liner appropriately within a container and subsequently to release a liner after use from a container, and in order to minimise the time required, various suspension techniques have been developed. Many of these techniques need the use of various hand or even power tools and require considerable care, in order to ensure the liner is not punctured or torn during installation, and will remain intact during loading of the product and the transportation thereof. However, during emptying, the liner should remain in its installed position and not tear or leak, other than at the discharge opening.

SUMMARY OF THE INVENTION

It is a principal aim of the present invention to provide a method whereby a flexible plastics material liner may relatively easily and quickly be secured within a cargo container, and also a liner suitable for securing within a cargo container by this method.

According to one aspect of the present invention, there is provided a method of securing a flexible plastics material liner within a cargo container using a plurality of retaining cords each associated with a respective self-jamming cleat, which method comprises the performance in any order of the following steps:

locating the liner within the cargo container;

coupling each cord to a respective predefined position on the liner;

coupling each cord to a respective attachment member provided within the container; and engaging each cord with its associated self-jamming cleat for locking thereby;

whereafter each self-jamming cleat is moved along its respective cord so that the cord comes under tension so as thereby to secure the liner within the container.

It will be appreciated that by the method of this invention, a liner may be suspended and secured within a cargo container using a plurality of retaining cords each of which is secured in position by means of a self-jamming cleat locked on to the cord. The method may be performed in a number of different ways, each having its own advantages. These ways include the following.

1. The cords may be coupled to the liner at the appropriate positions during the manufacture thereof and self-jamming cleats engaged with the cords. Then, when the liner is opened out and secured within a container, the cords are ready for use, to be coupled to appropriate members within the container.
2. The cords and cleats may be supplied separately from the liner to the liner installer, who may connect the cores at appropriate positions on the liner having regard to the container configuration immediately before installing the liner in a container.
3. During the manufacture of the liner, it may be provided with suitable receptors such as plastics material loops, through which the cords may subsequently be passed. The cords may then be coupled to members within the container, before the liner is installed, the cords being passed through the receptors on the finer as the liner is opened out. In this case, the self-jamming cleats may be pre-positioned on the cords, or may be fitted to the cords at the time of installing the liner in the container.

The method of this invention, using cords and self-jamming cleats, allows a liner to be secured to a container in a simple and efficient manner without the need for any hand tools. Thus, an operator is most unlikely to attempt to secure the liner in position other than in the pre-determined manner, using the cords, so reducing the likelihood of the liner tearing in use. Following the transport and unloading of products from the liner, it is a relatively easy matter to release the self-jamming cleats and so free the liner from the container, for disposal or recycling.

A particular advantage of the third possibility mentioned above is that on removing a used liner from a container, the cords may be left in the container ready for re-use with a fresh liner. In addition, the used liner will consist only of the plastic material from which it was originally made and this significantly enhances the recycling value of the liner.

In a case where the cords are attached to appropriate sites of a liner, during the manufacture thereof, or receptors for the cords are similarly attached, reinforcement may be added to those sites in order to minimise the likelihood of the liner tearing during use.

In a case where the cords are attached to a liner during the manufacture thereof, one end of each cord may be secured to the liner, with a self-jamming cleat provided at or adjacent the other end of the cord. In this case, to install a liner in a container, the cords may be passed through respective holes formed in members within the container, whereafter the self-jamming cleats are moved along the cords to engage a face of the respective member remote from the liner and thus suspend the liner from that member. Each hole may be large enough to allow the cord and cleat to be passed therethrough. Alternatively, the cord alone may be passed through the hole and the cleat then re-engaged with the cord.

Another possibility is for the cord to be secured to the liner part way between its ends, with the self-jamming cleat provided on one of the end portions, ready for engagement by the other end portion. In this case, the two cord portions may be passed round a member within the container whereafter the self-jamming cleat is used to lock together the two end portions. This technique may also be used when the liner is provided during manufacture with a receptor for a cord, which is passed through the receptor at the time of installing the liner.

In the methods of this invention, at least some, but possibly all, of the cords are elastic. In this case, the application of tension to a cord during the installation of a liner as the self-jamming cleat is fastened in the required position on that cord will have the effect of exerting a pre-load on the liner. This will help to ensure the liner stays in the correct position, particularly prior to and during loading with products.

It is preferred that the cleat is retained adjacent one end of the cord for example by means of a stopper furnished on the free end of the cord. This helps to ensure the cord and cleat are ready for use, irrespective of whichever technique is employed to install the liner within a container, and also facilitates re-use of the cords, in a case where they are not permanently attached to a liner.

The arrangements described above allow a liner to be fitted particularly easily into a cargo container with the liner in the correct position, since the container may be furnished with attachment members at suitable locations, and the liner having predefined sites for the cords. In this way, one may be assured that the liner has properly been fitted with a minimum likelihood of tearing of the liner during fitting or during use.

According to a second aspect of this invention, there is provided a flexible plastics material liner for a cargo container which liner is provided with a plurality of spaced retaining cords attached thereto, in combination with a like plurality of self-jamming cleats, one for each cord respectively, whereby the liner may be secured within a container by coupling each retaining cord to a part of the container and engaging the respective self-jamming cleat with each cord to secure the cord to said member so that the liner is suspended from the cords.

Most preferably, at least some, but possibly all, of the cords are elastic. This allows a pre-load to be imparted to the liner, so assisting the positioning of the liner in the correct position.

Self-jamming cleats are known and widely used in the yachting industry, and particularly in relation to relatively small sailing boats and dinghies. Various of those known forms of cleat could be employed in the present invention, though a preferred embodiment is for the cleat to be generally elongate and have formed therein an elongate aperture configured to allow entrapment of the cord. For example, the width of the aperture could decrease from one end of the cleat towards the other end thereof, passing the cord through the wider end of the cleat and then pulling the cord towards the other end, the cord becomes jammed in the cleat.

In the alternative, or in addition, teeth may be provided within the cleat for inter-engagement with the cord, so as thereby to trap the cord. Other forms of cleat may be employed, such as a cleat having a snail cam co-operating with a fixed surface or a pair of snail cams defining a nip through which the cord passes. Other suitable designs of self-jamming cleat will be apparent to those familiar with, or by researching, the marine industry.

Any of a number of different techniques may be employed for attaching the cord to the liner. In order to assist that attachment, the cord may carry at its end a substantially rigid member such as a rod or tube. Then, strips of self-adhesive tape having a relatively aggressive adhesive may be laid over the end of the cord and over said substantially rigid member, or the cord may be passed through a hole in a retaining panel, which panel then may be welded or otherwise adhered to the main area of the liner, so as to trap the substantially rigid member between the liner and the panel.

Liners of this invention may be made of any of those plastics materials from which the known cargo container liners are conventionally made. For example, polyethylene is particularly suitable for this purpose.

This invention extends to the combination of a container and a liner of this invention as described above, which liner is retained in the required position within the container by means of cords passing through members of, or provided within, the container and being held under tension by self-jamming cleats provided on the cords and bearing on said members.

BRIEF DESCRIPTION OF THE DRAWINGS

By way of example only, one specific embodiment of the present invention will now be described in detail, reference being made to the accompanying drawings in which:

FIG. 6 is a detail view of an alternative cord attachment to a liner, FIG. 6A showing the end portion of the cord;

FIG. 7 shows a further alternative attachment, using a cord end as shown in FIG. 6A;

DETAILED DESCRIPTION OF THE INVENTION

Figure 1:
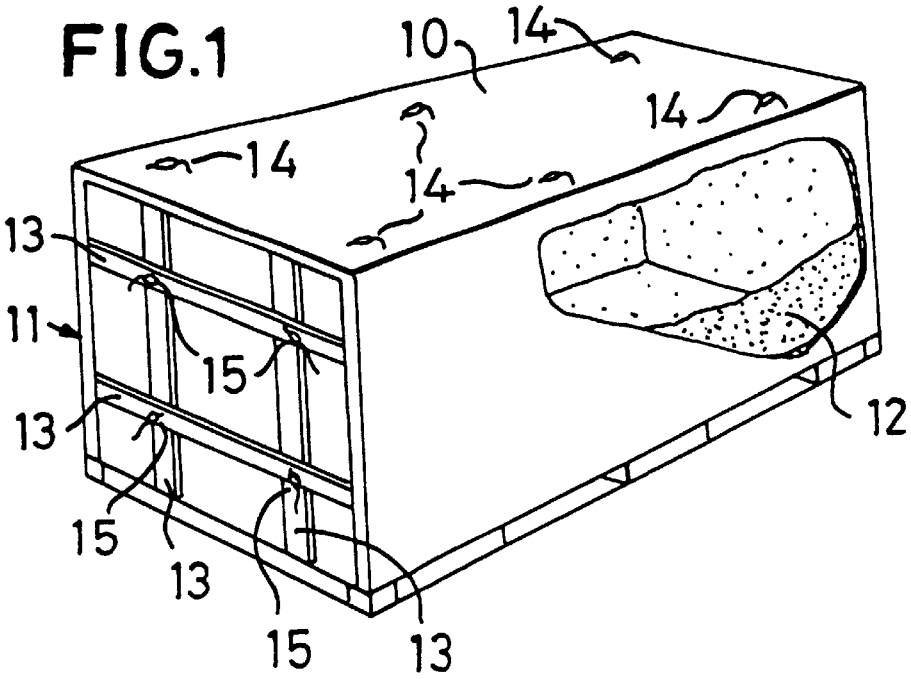
FIG. 1 is a diagrammatic view, partially cut-away, of a typical transport container having a liner fitted thereto in accordance with the present invention.

Referring initially to FIG. 1, there is shown a cargo transport container 10 of an entirely conventional design and which typically may be approximately 7 m long, and approximately 2.4 m×2.4 m in cross-section. Such containers are used very widely, for the transport of goods by road, rail and sea. Though not shown in FIG. 1, end 11 of the container is normally fitted with a pair of doors, hinged one to each upright edge at the end of the container and which may be secured in a closed position.

In order to allow such a cargo container to be used for the transport of flowable solid products in bulk, such as powders, granules and other like flowable solids, the container may be fitted with a liner 12 fabricated from polyethylene sheeting, typically having a thickness of about 150 $\mu$m. The liner is secured to the container at various points in order to ensure that it stays in the required position not only during transport of a contained product but also during emptying of the product out of the doored end 11 of the container. Typically, a framework of four wooden members 13 may be provided within that doored end 11 of the container, to ensure that on opening of the doors, the liner will be retained in position within the container, even if products in bulk are being transported within the liner.

Figure 2:
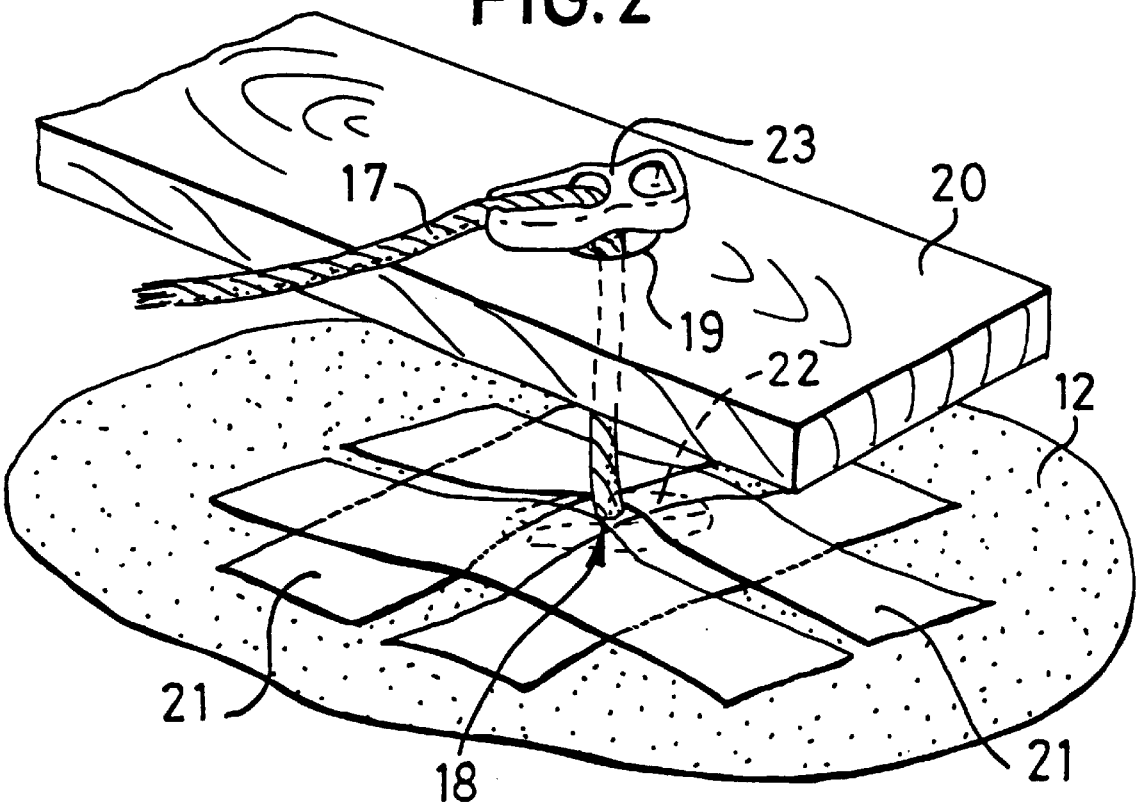
FIG. 2 is a detail view of one fixing for the liner shown in FIG. 1.

Fixings in accordance with the present invention are provided between the liner 12 and container 10, both along the top of the container as shown at 14 and to the members 13 as shown at 15. FIG. 2 illustrates one such fixing in greater detail.

Each fixing 14 or 15 includes an elastic shock-cord 17 having one end 18 attached to the liner 12 and passing through a hole 19 provided in a member 20 which forms part of or is furnished within the container. Said one end 18 of the cord 17 is attached to the liner 12 by means of strips 21 of self-adhesive tape, which pass over a short bar 22 attached to the end of the cord.

Figure 3:
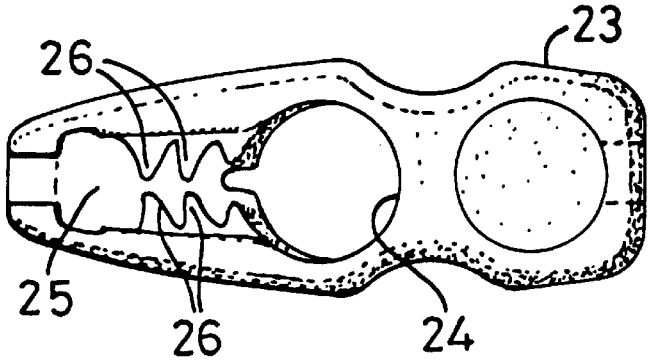
FIGS. 3 and 4 are respectively plan and under plan views on a preferred form of self-jamming cleat for use with the liner of this invention.
Figure 4:
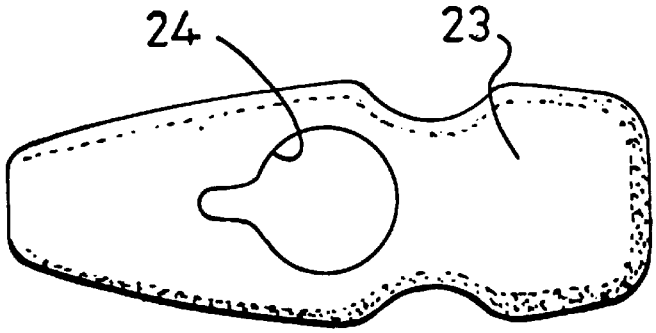

A self-jamming cleat 23 is arranged on the cord 17 and bears on the face of member 20 remote from the liner 12, so as to prevent that cord running through the member and coming free thereof. The cleat is shown in greater detail in FIGS. 3 and 4 and comprises a one-piece plastics moulding having a generally elongate shape with an aperture 24 extending therethrough. The aperture opens into a slot 25 extending lengthwise of the cleat, which slot is furnished with opposed gripping teeth 26.

The free end portion (not shown) of the cord 17 is provided with a stopper, which may take the form of a simple knot. This stopper should be formed on the end of the cord following threading of the cord through the aperture 24, so as to prevent subsequent removal of the cleat from the cord.

In use, the container 10 is provided with the cross-members 15 in the doored end of the container and either holes are drilled through the container at appropriate positions or in the alternative members having holes at appropriate positions are secured within the container. Then, the liner is placed within the container and unfolded, the cleats and cords being passed through the appropriate respective holes in the members. Tension is then applied to each cord by pulling on its free end and the cleat is moved along the cord until it engages the side face of the member through which that cord passes. The cleat is then jammed on to the cord so as to keep the tension therein.

Figure 5A:
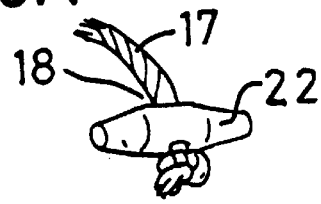
FIG. 5 is a detail view on one possible cord attachment to a liner, FIG. 5A showing just the end portion of the cord.
Figure 5:
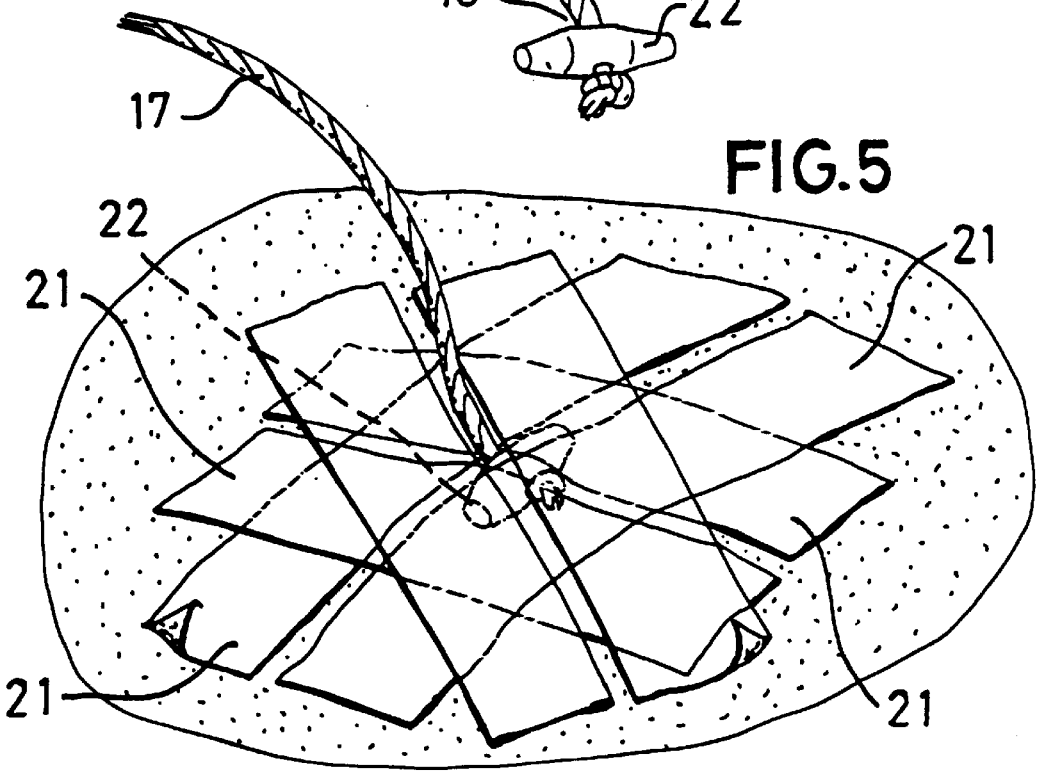

FIGS. 5 and 5A show in greater detail the attachment of end 18 of the cord 17 to the liner 12. As can be seen, the cord is passed through a hole formed transversely in bar 22, the end of the cord then being knotted to prevent the cord coming out of that hole. The application of strips 21 of self-adhesive tape having an aggressive adhesive over that bar and so as to adhere to the liner 12 will securely hold the cord 17 to the liner whilst also reinforcing that area of the liner and moreover distributing over an area of the liner any loads imparted to the cord.

An alternative arrangement is shown in FIGS. 6 and 6A. Here, a washer 27 is provided on the free end of the cord and again strips 21 of self-adhesive tape are employed to attach the washer to the liner 12. Instead of using strips of self-adhesive tape, a panel 28, also of a flexible plastics material, may be directly securerd to the liner 12 by one of a heat welding, chemical fusion or adhesive technique, the panel having a hole through which the cord passes so that the washer is located between the panel and the liner, as shown in FIG. 7. Another possibility is to attach the washer to the inside of the liner, with the cord passing through a hole formed in the liner, the hole being sealed by at least the peripheral region of the washer being bonded to the liner interior.

Figure 8:
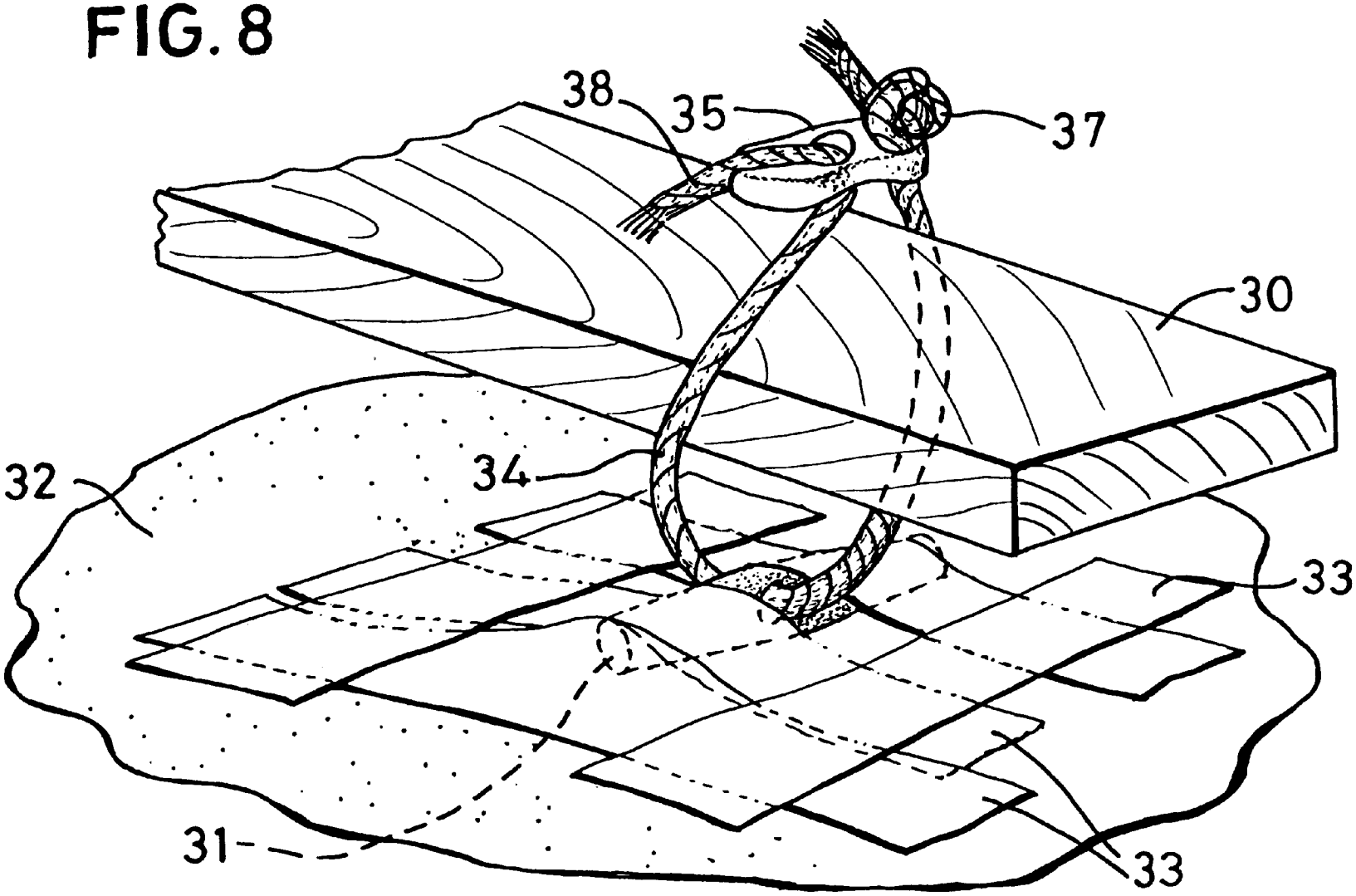
FIG. 8 is a detail view of an alternative fixing for the liner shown in FIG. 1.

FIG. 8 shows an alternative arrangement for fixing a liner to a wooden member 30 provided within a container (not shown). A bar 31 is secured to a face of a liner 32, using strips 33 of self-adhesive tape in a similar manner to that described with reference to FIGS. 2 and 5. A single elastic shock-cord 34 is passed through the bar 31, before that bar is taped to the liner, so that the bar is approximately in the central region of the cord. A self-jamming cleat 35, similar to that shown in FIGS. 3 and 4 but having a through-aperture at the right hand end (in FIG. 3) of the cleat, is threaded onto one of the end portions 36 of the cord 34 and is retained thereon by means of a knot 37. In order to prevent the cord 34 coming free of the bar 31 prior to the liner being installed, a further strip of tape (not shown) may be passed over the cord and bar.

In use, there is no need for a hole to be formed through member 30, unlike the arrangement with the previous embodiments. Instead, the liner is secured to the member 30 by passing the two parts of the cord around the member and threading the other end portion 38 of the cord through the self-jamming cleat retained on the one end portion 36. As with the previous embodiments, the liner may be tightened to the member 30 by pulling end portion 38 through the self-jamming cleat and locking the cleat on to that end portion at the appropriate position.

Figure 9:
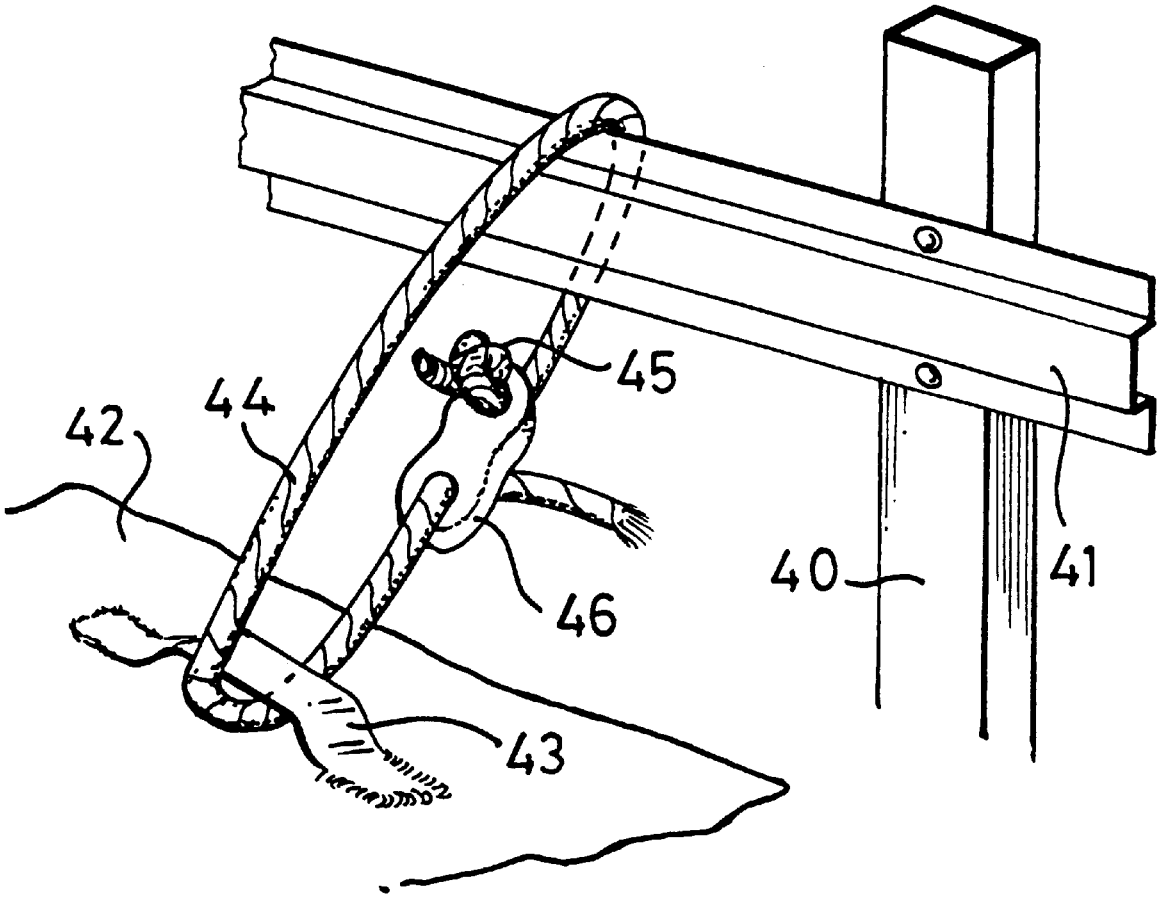
FIG. 9 is a detail view on yet another fixing for the liner shown in FIG. 1.

FIG. 9 shows yet another arrangement, similar to that of FIG. 8. In FIG. 9, there is shown an upright 40 which is a part of a conventional cargo container, there being a plurality of such uprights spaced along the side walls of the container. Extending between the uprights and fixed thereto are several parallel horizontal bars one of which is shown at 41 in FIG. 9. A liner 42 to be secured in the container is provided with a loop 43 of plastic material, which loop is heat-welded to the external face of the liner. Extra reinforcement, for example using adhesive tape or further pieces of plastic sheet also welded to the liner may be employed. The liner should have a plurality of such loops, provided at those positions from which the liner should be suspended.

With the arrangement of FIG. 9, the liner may be supplied without any cords or cleats, these being provided at the time of installing the liner in a container. Then, when the liner is to be installed, respective elastic cords 44 each having a stopper knot 45 at one end and a self-jamming cleat 46 threaded on to the cord to lie adjacent the knot may be passed through the loops 43 on the liner. The liner is opened out in the container and the cords passed round appropriate bars 41, threaded back through the associated cleats, pulled to be under tension, and then locked in the cleats by the self-jamming action thereof.

It will be appreciated that the cords could be threaded through the loops 43 during the manufacture of the liner. Alternatively, the cords could be passed round the bars 41 in the container, and left there ready for use when a liner is to be installed.

When the liner is to be removed, after transported product has been discharged, it is a relatively easy matter to release the cords from their respective self-jamming cleats and pull the liner free of the cords, leaving the cords in the container ready for use with a fresh liner. This has the advantage that the liner, when removed, may consist solely of the plastic material from which the liner has been made; the liner thus has enhanced recycling value, and the cost associated with installing a fresh liner is reduced.

What is claimed is:

1. A method of securing a flexible plastics material liner within a cargo container using a plurality of retaining cords each associated with a respective self-jamming cleat, each cleat having an opening therethrough and through which the respective cord is in use passed and said cleat further having a pair of fixed jaws defining therebetween an elongate slot for receiving the cord, which jaws are provided with opposed gripping surfaces between which the cord may be jammed and the slot having a first end in communication with said opening and a second end which is open which method comprises the performance in any order of the following three steps:

locating the liner within the cargo container;

coupling each cord to a respective predefined position on the liner;

coupling each cord to a respective attachment member provided within the container;

whereafter the method further comprises the performance of the following steps:

passing each cord through the opening of its associated self-jamming cleat; and moving each self-jamming cleat along its respective cord so that the cord comes under tension and then jamming the cord between said gripping surfaces of said jaws of the cleat by pressing the cord into the slot so as to pass out of the open other end of the slot, thereby securing the liner within the container.

2. A method as claimed in claim 1, wherein at the time of installing the liner in a cargo container, each cord is passed through a respective receptor for the cord provided on the liner during the manufacture thereof.

3. A method as claimed in claim 2, wherein each said receptor comprises means defining an aperture for the cores and attached to the liner, through which aperture the cord is passed.

4. A method as claimed in claim 1, wherein each cord is permanently coupled to a respective predefined position on the liner before the liner is inserted into the cargo container.

5. A method as claimed in claim 4, wherein each cord is coupled to the liner at a position intermediate the length of the cord so as to provide two cord portions extending away from the liner, from said position.

6. A method as claimed in claim 1, wherein each self-jamming cleat is provided on a respective cord at or adjacent one end thereof and following the coupling of the cord with a respective attachment member of the container, the other end of each cord is passed through the opening of the respective self-jamming cleat ready for locking thereby.

7. A method as claimed in claim 5, wherein each cord is coupled to the respective attachment member by being passed therearound whereafter said other end of the cord is passed through the opening of the self-jammed cleat.

8. A method as claimed in claim 1, wherein each cord is passed through a respective hole formed in one of said attachment members of the cargo container and a member provided with in the container, whereafter the self-jamming cleat is moved along the cord from a position at or adjacent the free end of the cord whilst tension is applied to the cord, the cleat being moved as aforesaid until bearing on a face of the member remote from the liner.

9. A method as claimed in claim 1, wherein each cord is elastically extensible.

10. A method as claimed in claim 1, wherein each self-jamming cleat is retained or its respective cord by means of a stopper provided on a free end of the cord.

11. A flexible plastics material liner for a cargo container which is provided with a plurality of spaced retaining cords attached thereto, in combination with a like plurality of self-jamming cleats, one for each cord respectively, each cleat having an opening therethrough and through which the respective cord is in use passed and each said clear t having a pair of fixed jaws defining therebetween an elongate slot for receiving the cord which jaws are provided with opposed gripping surfaces between which the cord can be jammed, and the slot having a first end in communication with said opening and a second end which is open, whereby the liner may be secured within a container by coupling each retaining cord to an attachment member of the container, passing each cord through the opening of the associated self-jamming cleat, moving each self-jamming cleat along its respective card so that the cord comes under tension, and then jamming the cord between gripping surfaces of jaws of the cleat by pressing the cord into the slot so as to pass out of the open other end of the slot, thereby to secure the cord to said attachment member so that the liner is suspended from the cords thus securing the liner within the container.

12. A liner as claimed in claim 11, wherein at least some of the cords are elastically extensible.

13. A liner as claimed in claim 11, wherein each cleat is elongate and has formed therein a second aperture for receiving another end portion of said cord.

14. A liner as claimed in claim 13, wherein said another end of the cord is passed through said second aperture through the respective cleat and is secured thereto prior to fitting of the liner into a container.

15. A liner as claimed in claim 13, wherein said gripping surfaces of said jaws comprise teeth for interengagement with the cord to assist with the self-jamming function of the cleat.

16. A liner as claimed in claim 11, wherein each cord is attached to the liner by means of self-adhesive tape gripping the liner and retaining the cord or cords thereto.

17. A liner as claimed in claim 11, wherein each cord is attached to the liner by means of a retaining panel through which the cord passes and which is welded or adhered to the main area of the liner.

18. A liner as claimed in claim 16, wherein each cord carries a substantially rigid member at its end attached to the liner.

19. A liner as claimed in claim 11, wherein at least some of the cords are attached to the liner intermediate their ends.

20. A liner as claimed in claim 11, wherein the liner is manufactured from polyethylene sheet.

21. A liner as claimed in claim 11 in combination with a cargo container, which liner is retained in the required position within the container by means of cords coupled to attachment members of the container and being held under tension by self-jamming clears provided on the cords to secure the cords to the members.

* * * * *

UNITED STATES PATENT AND TRADEMARK OFFICE

CERTIFICATE OF CORRECTION

PATENT NO. : 6,308,855 B1
DATED : October 30, 2001
INVENTOR(S) : Tisi

It is certified that error appears in the above-identified patent and that said Letters Patent is hereby corrected as shown below:

Claim 3,
Line 22, "cores" should read -- cord --.

Claim 8,
Line 45, "with in" should read -- within --.

Claim 10,
Line 53, "or" should read -- on --.

Claim 11,
Line 56, "which is" should read -- which liner is --.
Line 4, "clear t" should read -- cleat --.
Line 14, "card" should read -- cord --.

Claim 21,
Line 53, "clears" should read -- cleats --.

Signed and Sealed this

Twelfth Day of March, 2002

*Attest:*

*Attesting Officer*

JAMES E. ROGAN
*Director of the United States Patent and Trademark Office*